US005190284A

United States Patent [19]

Diaz

[11] Patent Number: 5,190,284

[45] Date of Patent: Mar. 2, 1993

[54] SHOULDER ALIGNMENT TRAINING DEVICE FOR GOLFERS

[76] Inventor: Arthur Diaz, 3217 N. "B" St., Tampa, Fla. 33609

[21] Appl. No.: 885,181

[22] Filed: May 19, 1992

[51] Int. Cl.[5] ..... A63B 69/36

[52] U.S. Cl. ..... 273/35 A; 273/187 R

[58] Field of Search ..... 273/35 A, 187 R, 187 A, 273/187 B, 187.6, 187.1; 434/252

[56] References Cited

U.S. PATENT DOCUMENTS

| | | | |
|---|---|---|---|
| 3,934,874 | 1/1976 | Henderson | 273/35 A |
| 3,934,882 | 1/1976 | Whittaker | 273/35 A X |
| 4,678,193 | 7/1987 | Kronogard | 273/35 A X |

*Primary Examiner*—George J. Marlo

*Attorney, Agent, or Firm*—Joseph C. Mason, Jr.; Ronald E. Smith

[57] ABSTRACT

A training aid for golfers includes and elongated board that serves as a base member and a dowel pin that is inserted in a preselected transversely disposed throughbore formed in the board. A mirror having a longitudinally extending marking stripe applied to it is fixedly secured to the flat top surface of the board. With the training aid positioned between the golfer and the ball, the golfer orients his or her feet relative to the board and dowel pin in a predetermined way, and aligns his or her shoulders, hands, and head with the marking stripe during the set-up. The position of the club may also be observed during a slow motion practice swing, but the mirror is not observed after the set-up if the ball is to be hit with a regular swing. With practice, the golfer acquires a muscle memory of a proper set-up, and a properly executed golf swing. Further structural details include mounting blocks for storing the dowel pin when not in use and a mirror protector that is releasably attachable to the base member in overlying relation to the mirror.

7 Claims, 3 Drawing Sheets

SHOULDER ALIGNMENT TRAINING DEVICE FOR GOLFERS

BACKGROUND OF THE INVENTION

1. Technical Field

This invention relates, generally, to devices having utility in training golfers. More particularly, it relates to a device that enables a golfer to see the position of his or her shoulders, head and hands when preparing to address a ball.

2. Description of the Prior Art

U.S. Pat. No. 4,563,010 to McDorman shows a training device for golfers that employs a system of mirrors that enables the golfer to see the target while looking at the ball. Thus, the device is aligned parallel with the target, and the golfer aligns his or her body with the device. Thus, at least to some extent, the McDorman device is a training aid. However, it does not teach the golfer how to position his or her body to achieve an effective swing.

Other U.S. patents of interest include Nos. 3,000,261, 3,097,437, 4, 678,193, 3,868,116, 4,925,192, 4,181,307, and 4,927,153, all of which show miscellaneous golf-training devices, and none of which teach or suggest the invention to be disclosed herein.

SUMMARY OF THE INVENTION

The novel training aid includes a base member having a predetermined length, width, and thickness. In a preferred embodiment, the base member may be realized by a board that is about two feet in length, one and one-half inches in thickness, and about three and one-half inches in width; none of these dimensions are critical to the invention, however.

A plurality of preferably three transversely disposed throughbores are drilled in the base member, at longitudinally spaced intervals along the extent thereof. An elongate dowel pin is slidably inserted in a selected throughbore when the device is to be used; a trailing end of the dowel pin extends from the side of the base member to where the golfer stands during the training session, and the leading end of the dowel pin extends from the opposite side thereof, where the ball to be addressed is positioned. A right-handed golfer will position the dowel pin in the bore nearest the target, as will a left-handed golfer, but the bore will be different for said golfers. The middle bore receives the dowel pin when the golfer is practicing with a sand wedge, a pitching wedge, or other more lofted club. Practice putts and regular putts may also be executed with the dowel pin in the middle bore.

An elongate mirror having substantially the same longitudinal and transverse extent as the base member is fixedly secured to the top wall of the base member, and a marker means in the form of a stripe is painted or otherwise applied to said mirror in longitudinally bisecting relation thereto.

To use the device, the golfer selects a throughbore and extends the dowel pin through it; the device is then placed on the ground between the golfer and the ball, with the longitudinal axis of the device in substantial alignment with the intended flight path of the ball. The leading end of the dowel pin is positioned in close proximity to the golf ball, in spaced relation thereto, on the trailing side thereof, i.e., on the side nearest the golfer. Where a driver is to be used, a right-handed golfer stands with feet at shoulder width and places the heel of his or her left foot on the left side of the dowel pin, preferably in abutting relation thereto, positions his or her head behind the ball (with the target being in front of the ball), and aligns his or her shoulders with the stripe on the mirror. The positions of other parts of the body, such as the hands and head, are also observed and placed into proper alignment. The swing may be practiced by first going through the backswing slowly while observing the club in the mirror, and then going through the forward swing slowly while continuing to monitor the mirror. In this way, the golfer develops the muscle memory needed to perfect a golf swing. When a ball is to be addressed, the parts of the body are observed in the mirror during the set-up, but the device is then ignored because the golfer must concentrate on hitting the ball with a normal-speed swing.

In an alternate embodiment, a flexible extension member is added to the leading end of the dowel pin and the ball is positioned just beyond the leading end of said flexible member so that if the golfer misses the ball and strikes said extension member, said member, unlike the rigid dowel pin, will give way.

Means are also provided to hold the dowel pin in closely spaced longitudinal alignment with the base member when the device is not in use, and further means are provided to cover the mirror when the device is in storage.

Thus, it is understood that the primary object of this invention is to provide a training device that teaches a golfer how to position his or her shoulders, hands, and head prior to a golf swing.

Another object is to provide a training device that enables a golfer to observe the position of the club and certain body parts during a slowly executed take-away and forward swing.

A more specific object is to provide such a device in a structurally simple, elegant form so that it will be economical to manufacture and therefore affordable.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
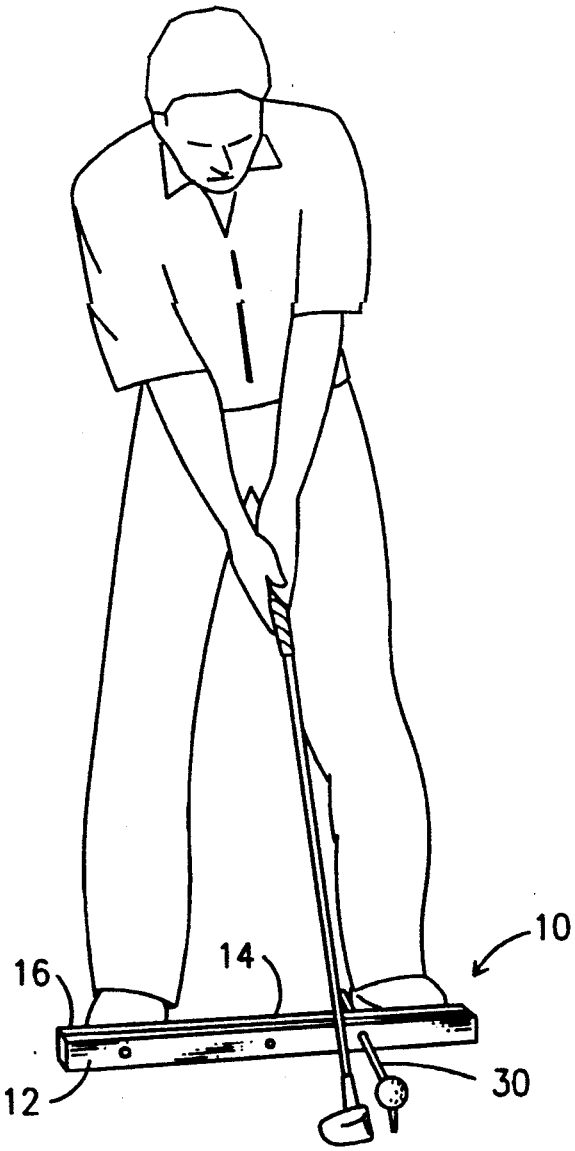
FIG. 1 is a perspective view of a golfer using the device with a driver.

Referring now to FIG. 1, it will there be seen that an illustrative embodiment of the invention is denoted as a whole by the reference numeral 10.

Device 10 includes base member 12 of predetermined length, width, and thickness; it may be solid or hollow and made of any suitable material. As perhaps best shown in FIG. 5, base member 12 includes a flat top wall 14 to which is fixedly secured a mirror 16 which is substantially coextensive with said top wall. A stripe of paint 18 or other suitable marking means is applied to said mirror in longitudinally bisecting relation thereto.

Base member 12 further includes vertical side walls 20, 20. A plurality of transversely disposed throughbores, collectively denoted 22, extend between said side walls 20, 20, and are longitudinally spaced from one another as shown.

Vertical end walls 24, 26 are wholly or partially covered by pads 25, 27, respectively, of hook or loop fastening means. A mating hook or loop fastening means 25*a*, 27*a* may be sewed or otherwise affixed to the opposite ends of protective means or cover member 28, which is made of cloth or a cloth-like material, so that mirror 16 may be covered by releasably securing the opposite ends of the cover member 28 to the pads. Alternatively, cover member 28 may be made of a cloth or cloth-like material that releasably engages hook and loop fastening members, thereby obviating the need for pads 25*a*, 27*a*. In either construction, the longitudinal extent of the protective means is greater than the longitudinal extent of the base member so that the opposite ends of the protective means 28 will at least partially overlie said vertical end walls.

An elongate dowel pin 30, shown in FIGS. 1–4, is selectively slidably insertable into a throughbore 22 when the inventive device is to be used. The trailing end of the dowel pin is defined as that end thereof on the side of the device where the golfer stands, and the leading end of the dowel pin is defined as the end thereof on the side of the device where the golf ball is positioned.

Figure 4:
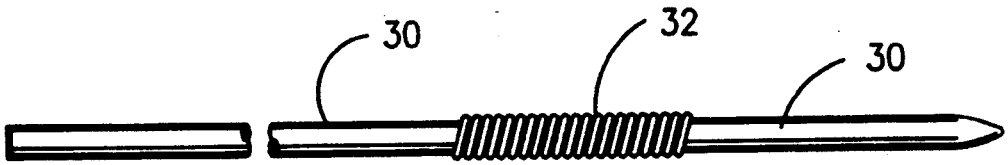
FIG. 4 is a front elevational view of the novel dowel pin that forms a part of the invention.

Dowel pin 30 may be provided in two parts and those two parts may be interconnected by a flexible interconnecting means such as a spring 32, best depicted in FIG. 4. If the golfer misses the ball and strikes the leading end of the pin, the spring will flex so that said pin is not broken. FIG. 1 shows a dowel pin 30 having only one part, i.e., the leading and trailing end of pin 30 in FIG. 1 are integrally formed with one another and are thus not interconnected by spring 32.

Figure 5:
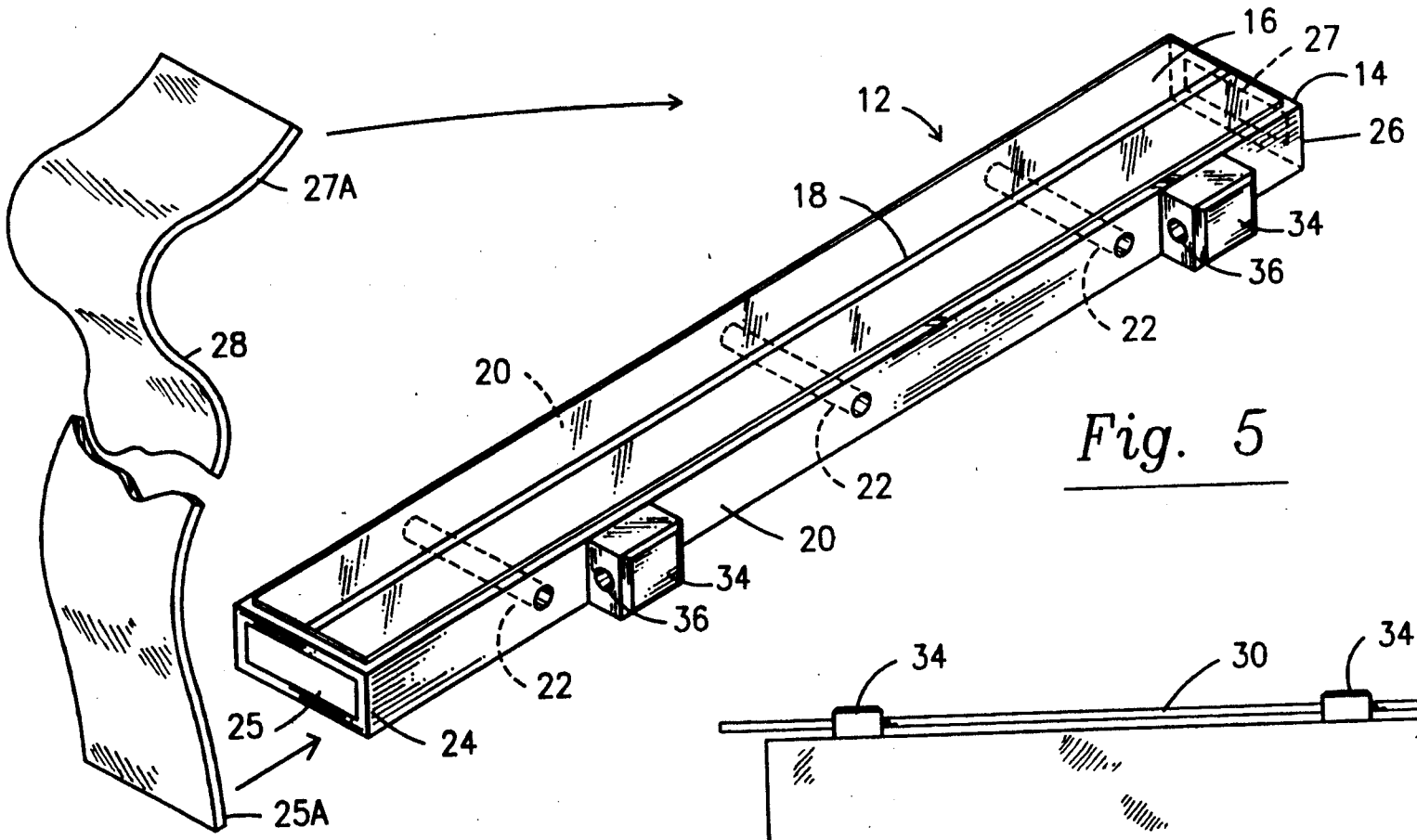
FIG. 5 is an exploded perspective view of the base part of the device and the protective cover means.
Figure 6:
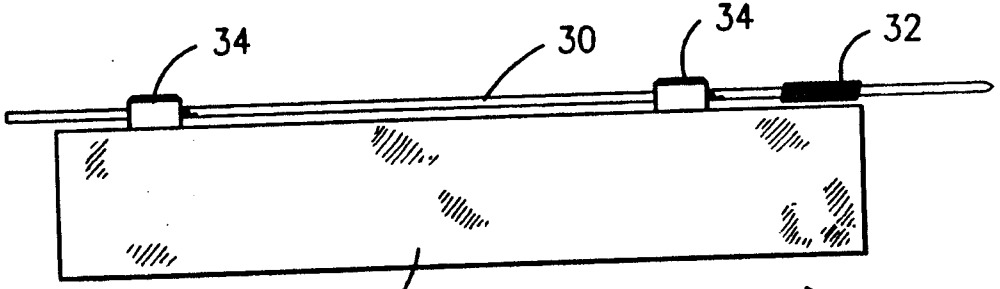
FIG. 6 is a front elevational view of the device with its dowel pin in its stored configuration and with the mirror covered by the protective cover means.

A dowel pin storage means in the form of a pair of mounting blocks, collectively denoted 34 and best shown in FIGS. 5 and 6, is advantageously secured to a preselected side wall 20 and each of said mounting blocks are bored as at 36 to slidably receive dowel pin 30 in the manner depicted in FIG. 6. When the dowel pin is so stored, it is disposed in closely spaced parallel relation to base member 12 and is therefore substantially protected from breakage and from loss arising from separation from base member 12.

Figure 2:
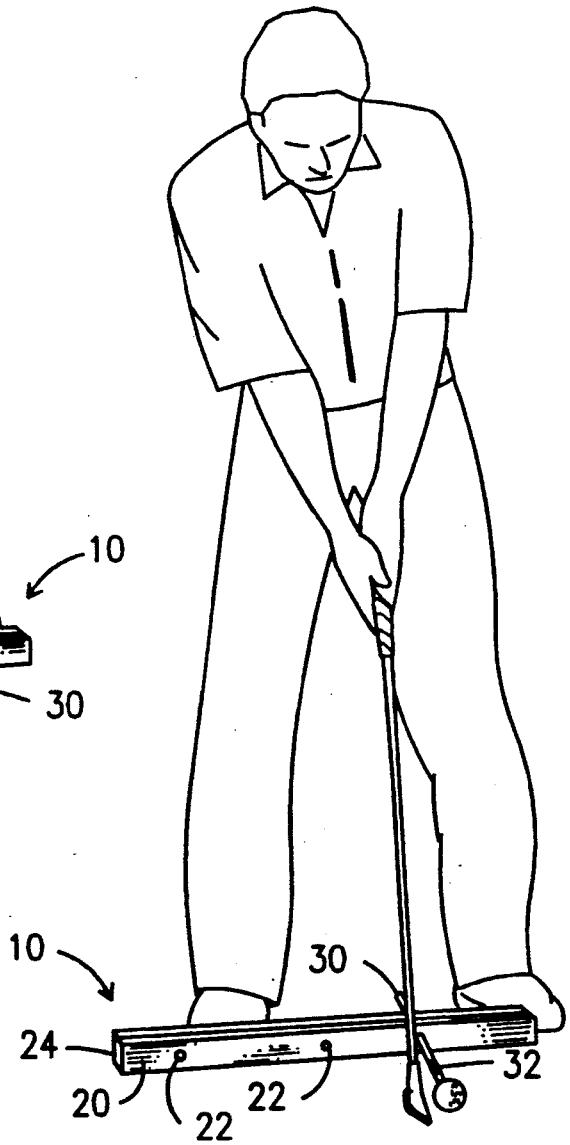
FIG. 2 is a perspective view of a golfer using the device with an iron.
Figure 3:
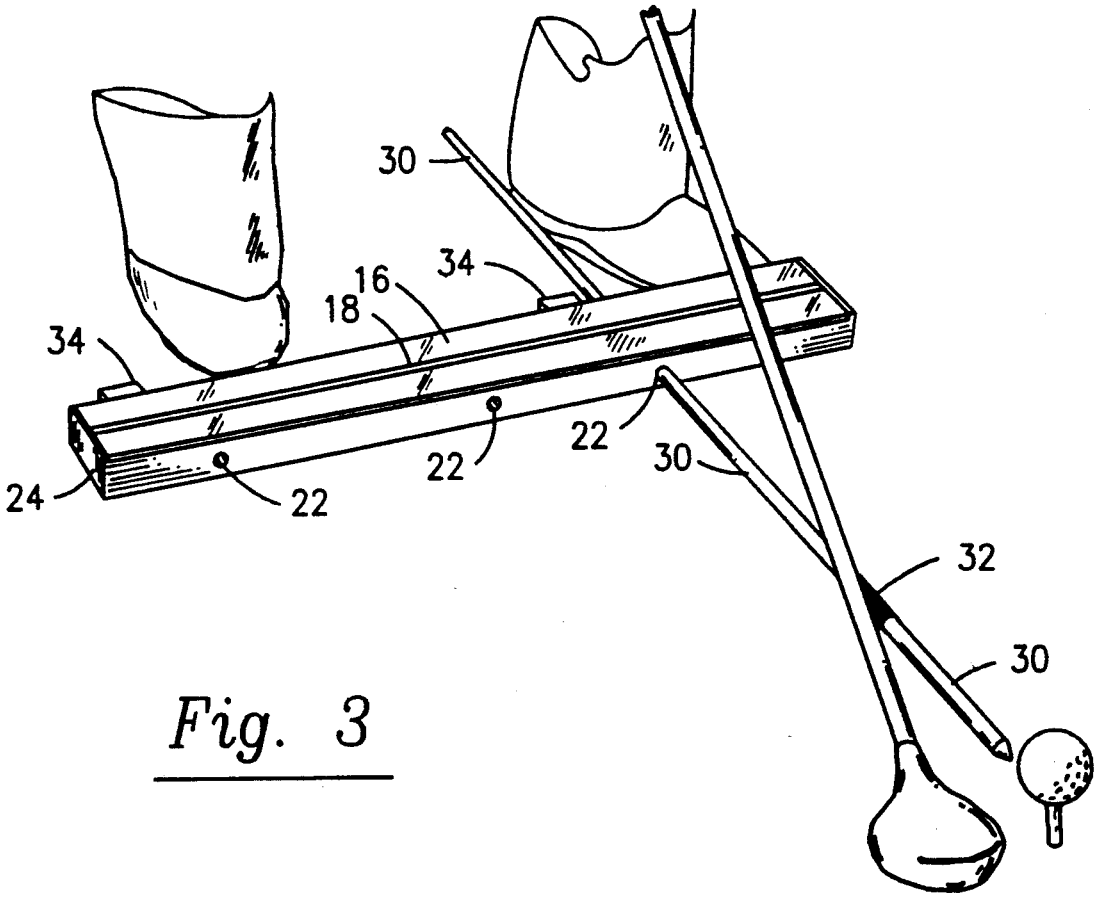
FIG. 3 is an enlarged view of the device relative to the size thereof depicted in FIGS. 1 and 2.

Proper use of the device is perhaps best understood in connection with FIGS. 1 and 2. Device 10 is positioned between the golfer and the ball, and the base member 12 is aligned so that it points toward the intended flight path of the ball. Dowel pin 30 is slid through a preselected throughbore 22 so that its trailing end extends into the golfer's space and so that its leading end is near the ball to be addressed. The golfer places the leading, i.e., the toe end, of his or her golf shoes in abutting, or nearly abutting, relation to the side wall 20 facing the golfer, and places the heel of the leading shoe against, or nearly against, the trailing end of the dowel pin as depicted in FIG. 1. This stance is preferred for a shot using a driver. For a right-handed player, the ball is played just off the left heel, as indicated by the position of the dowel against the heel of the golfer's left foot in said FIG. 1. A different stance might be required in connection with the use of a different club, such as a five iron, for example. Where a five iron is to be used, the leading heel of the golfer is spaced about six inches in front of the dowel pin, where the phrase "in front of" is defined as being closer to the target towards which the ball is to be delivered as distinguished from a position further away from said target. This position is depicted in FIG. 2. Thus, the ball in FIG. 2 is six inches away from the golfer's left heel toward the center of the stance. Where a fairway wood is used, the golfer's leading foot would be positioned about two inches in front of the dowel pin.

Independently of which stance is selected, the head of the golfer is positioned behind the ball, i.e., on the side of the ball more remote from the target. The golfer then observes, in mirror 16, the position of his or her shoulders, arms, and head relative to the straight line 18, and corrects his or her position as needed. As mentioned earlier, the device is then disregarded if a regular swing is to be executed. Where one or more practice swings are to be executed, the shoulders and arms are squared with respect to the line 18, i.e., are brought into alignment with the line before the backswing (the "take-away") begins, i.e., during the "set-up". When the take-away is completed, the position of the club is then observed; it should be parallel to stripe 18. Similar observations are then made as the practice swing is executed. In this way, the golfer acquires muscle memory of a good set-up, take-away, and forward swing.

Device 10 has a structural elegance of irreducible simplicity. It is compact in size and light in weight so it is easily transportable to a practice area. Just as importantly, it lacks the complicated system of mirrors and numerous adjustment mechanisms of the type found in prior art devices. It performs its intended task effectively and in a manner heretofore unknown.

This invention is clearly new and useful. Moreover, it was not obvious to those of ordinary skill in this art at the time it was made, in view of the prior art considered as a Whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A training aid for golfers, comprising:

an elongate base member having a longitudinal axis of symmetry;

said base member including an elongated flat top wall;

an elongated mirror fixedly secured to said flat top wall;

an elongate marking means applied to said mirror, said marking means substantially longitudinally bisecting said mirror;

at least one transversely disposed throughbore formed in said base member and below said mirror; and an elongate dowel pin for slidable insertion within said at least one throughbore;

whereby said dowel pin is positioned in a preselected throughbore of said at least one throughbore, said base member is positioned between a golfer and a golf ball with said base member aligned with a target, the golfer's feet are positioned in a predetermined relationship relative to said base member and said dowel pin, and the golfer's shoulders, head, and hands are aligned with said marking means during the set-up.

2. The training aid of claim 1, wherein said dowel pin includes a leading end and a trailing end that are formed separately from one another, and further comprising a flexible interconnecting means for interconnecting said leading and trailing ends to one another so that said dowel pin does not break if a golf clubhead strikes the leading end of said pin.

3. The training aid of claim 2, further comprising storage means for storing said dowel pin when said dowel pin is not in use.

4. The training aid of claim 3, wherein said storage means includes a pair of longitudinally spaced apart mounting blocks that are fixedly secured to said base member and which are bored to slidably receive said dowel pin therein so that said dowel pin is disposed in closely spaced parallel relation to said base member when said dowel pin is in its stored configuration.

5. The training aid of claim 4, further comprising aid is not in use.

6. The training aid of claim 5, wherein said protective means is an elongate cloth-like material that overlies said mirror and which is releasably secured to said base member at opposite ends of said base member, said protective means having a longitudinal extent greater than the longitudinal extent of said base member so that its opposite ends at least in part overlie said opposite ends of said base member.

7. The training aid of claim 6, wherein said base member is a board having a predetermined length, thickness, and width.

* * * * *